US008308262B2

(12) United States Patent
Yoshida et al.

(10) Patent No.: US 8,308,262 B2
(45) Date of Patent: Nov. 13, 2012

(54) IMAGE FORMING APPARATUS AND IMAGE FORMING METHOD

(75) Inventors: Minoru Yoshida, Tokyo (JP); Hiroshi Hashidume, Tokyo (JP); Makoto Tani, Kanagawa-ken (JP); Osamu Takagi, Tokyo (JP); Takahisa Hirano, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 358 days.

(21) Appl. No.: 12/574,339

(22) Filed: Oct. 6, 2009

(65) Prior Publication Data

US 2010/0097421 A1 Apr. 22, 2010

Related U.S. Application Data

(60) Provisional application No. 61/107,515, filed on Oct. 22, 2008.

(30) Foreign Application Priority Data

Sep. 15, 2009 (JP) ..... 2009-212651

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 15/10*** | (2006.01) |

(52) U.S. Cl. ..... 347/14; 347/102; 347/172; 347/179

(58) Field of Classification Search ..... None
See application file for complete search history.

(56) References Cited

U.S. PATENT DOCUMENTS

| | | | | |
|---|---|---|---|---|
| 4,661,703 | A * | 4/1987 | Ishikawa et al. | 250/317.1 |
| 5,452,058 | A | 9/1995 | Umeda | |
| 6,154,243 | A * | 11/2000 | Tatewaki et al. | 347/223 |
| 6,527,384 | B2 | 3/2003 | Isago | |
| 2005/0122357 | A1 * | 6/2005 | Sakuraba et al. | 347/14 |
| 2008/0074483 | A1 * | 3/2008 | Sugahara | 347/102 |
| 2008/0151033 | A1 * | 6/2008 | Ishimi et al. | 347/179 |
| 2009/0154970 | A1 | 6/2009 | Yoshida et al. | |

FOREIGN PATENT DOCUMENTS

| | | |
|---|---|---|
| JP | 2001-171213 | 6/2001 |
| JP | 2001-228751 | 8/2001 |
| JP | 2001-341429 | 12/2001 |
| JP | 3286214 | 3/2002 |
| JP | 2002-361983 | 12/2002 |
| JP | 2005-089548 | 4/2005 |
| JP | 2005-170014 | 6/2005 |

OTHER PUBLICATIONS

Japanese Office Action for Japanese Application No. 2009-212651 mailed on Apr. 19, 2012.

* cited by examiner

*Primary Examiner* — Stephen Meier
*Assistant Examiner* — Alexander C Witkowski
(74) *Attorney, Agent, or Firm* — Turocy & Watson, LLP

(57) ABSTRACT

An image forming apparatus includes an image forming portion to form an image on a sheet using an erasable ink, a sheet supply tray to load the sheet on which the image was formed using the erasable ink, a mark detecting portion to detect a mark indicating that the image formed on the sheet conveyed from the sheet supply tray includes a confidential information, and an overwriting portion to overwrite so as not to make recognizable the image of at least an area including the confidential information out of the image formed on the sheet, in case that the mark is detected by the mark detecting portion.

22 Claims, 11 Drawing Sheets

THE COMPOSITION OF THE MAIN COMPONENT OF THIS PIGMENT IS

BY ADDING

THE COMPOSITION OF THE MAIN

COMPONENT OF THIS FIGMENT IS

DISTRIBUTION INHIBITED $Cu_3(CO_3)_2(OH)_2$

DISTRIBUTION INHIBITED

TO A SMALL AMOUNT OF

DISTRIBUTION INHIBITED

PTSD

DISTRIBUTION INHIBITED

BY ADDING

FIG. 11

IMAGE FORMING APPARATUS AND IMAGE FORMING METHOD

CROSS-REFERENCE TO RELATED APPLICATION

This application is based upon and claims the benefit of priority from the prior U.S. Patent Application No. 61/107,515, filed on Oct. 22, 2008, and Japanese Patent Application No. 2009-212651, filed on Sep. 16, 2009; the entire contents of all of which are incorporated herein by reference.

FIELD OF THE INVENTION

The present invention relates to an image forming apparatus and an image forming method which can reuse a sheet.

DESCRIPTION OF THE BACKGROUND

Conventionally, as a system to reuse a sheet, an inkjet printer and so on are proposed which prints an ink including the leuco dye by an inkjet apparatus and erases using a thermal bar or a thermal head.

In Japanese Patent Application Publication No. 2001-302954, an ink is disclosed which exhibits colors by the chemical combination of the coloring substance and the developer at a normal temperature equal to or lower than 40° C., the chemical combination breaks down at a temperature equal to or larger than 100° C., and is made colorless by the chemical combination of the developer and the decolorizing agent. In addition, in Japanese Patent Application Publication No. 2001-302954, an inkjet printer using the ink and further an inkjet printer for both the recording and erasing use provided with a heating mechanism for erasing are disclosed.

In addition, in Japanese Patent Application Publication No. 2005-89548, an ink material having a hysteresis property in the coloring and decolorizing curve in order to fix the coloring and decolorizing at the room temperature.

However, in case that the sheet is to be reused which the image is formed on and decolorized from using the ink as disclosed in Japanese Patent Application Publications No. 2001-302954 and No. 2005-89548, the ink might exhibit colors again when the sheet is cooled. This is because the pigment and the developer once separated off by heating recombines under the circumstance equal to or lower than a prescribed temperature that is lower than the normal temperature. That is, the image formed in past times can made be reappeared intentionally by cooling the sheet after erasing. Accordingly, the content erased for the reuse might be leaked to the third party, causing a great problem in security.

SUMMARY OF THE INVENTION

An object of the present invention is to provide an image forming apparatus and an image forming method which can withhold the content erased for the reuse from reappearing again and can improve the confidentiality.

To achieve the above advantage, the aspect of the present invention is to provide an image forming apparatus, comprising: an image forming portion to form an image on a sheet using an erasable ink; a sheet supply tray to load the sheet on which the image was formed using the ink; a mark detecting portion to detect a mark indicating that the image formed on the sheet conveyed from the sheet supply tray includes a confidential information; and an overwriting portion to overwrite so as not to make recognizable the image of at least an area including the confidential information out of the image formed on the sheet, in case that the mark is detected by the mark detecting portion.

Further, to achieve the above advantage, the aspect of the present invention is to provide an image forming apparatus, comprising: a first sheet supply tray to load a used sheet on which an image was formed on the sheet using an erasable ink; a second sheet supply tray to load a used sheet on which a confidential information was formed on the sheet using the erasable ink; an image eraser to erase the image printed on the used sheet conveyed from the first sheet supply tray; and an overwriting portion to form an image on the sheet using the erasable ink and to overwrite a pattern so as not to make recognizable the image formed in past times on the used sheet conveyed from the second sheet supply tray.

Further, to achieve the above advantage, the aspect of the present invention is to provide an image forming method, comprising: forming an image on a sheet using an erasable ink; detecting a mark indicating that the image formed on the sheet includes a confidential information; and overwriting so as not to make recognizable the image of at least an area including the confidential information out of the image in case that the mark is detected.

BRIEF DESCRIPTION OF THE DRAWINGS

FIG. 11 is a diagram showing another overwritten example so that the image formed in past times might not be read.

Figure 2:
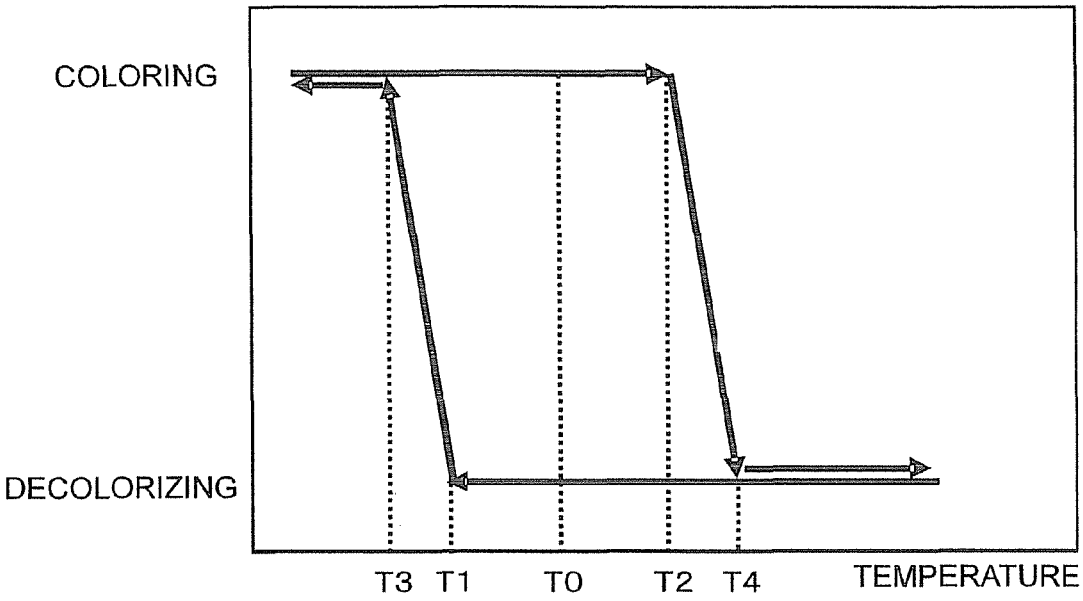
FIG. 2 is a graph showing the temperature property of an ink used in the image forming apparatus in the first embodiment.
Figure 3:
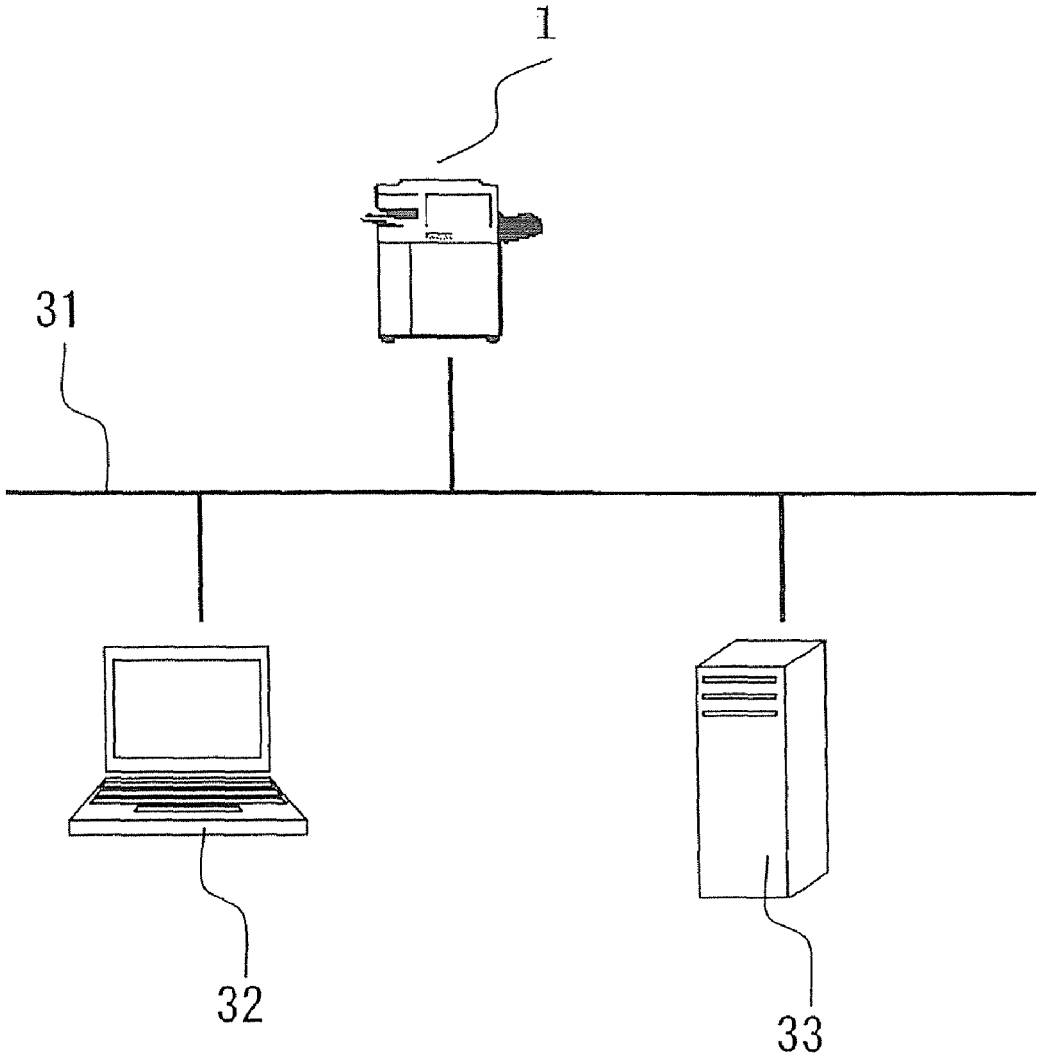
FIG. 3 is a schematic view showing a system in which the image forming apparatus in the first embodiment and a server and so on are connected.

DETAILED DESCRIPTION OF THE INVENTION (First Embodiment) Hereinafter, a first embodiment according to the present invention will be described with reference to FIG. 1 through FIG. 3.

Figure 1:
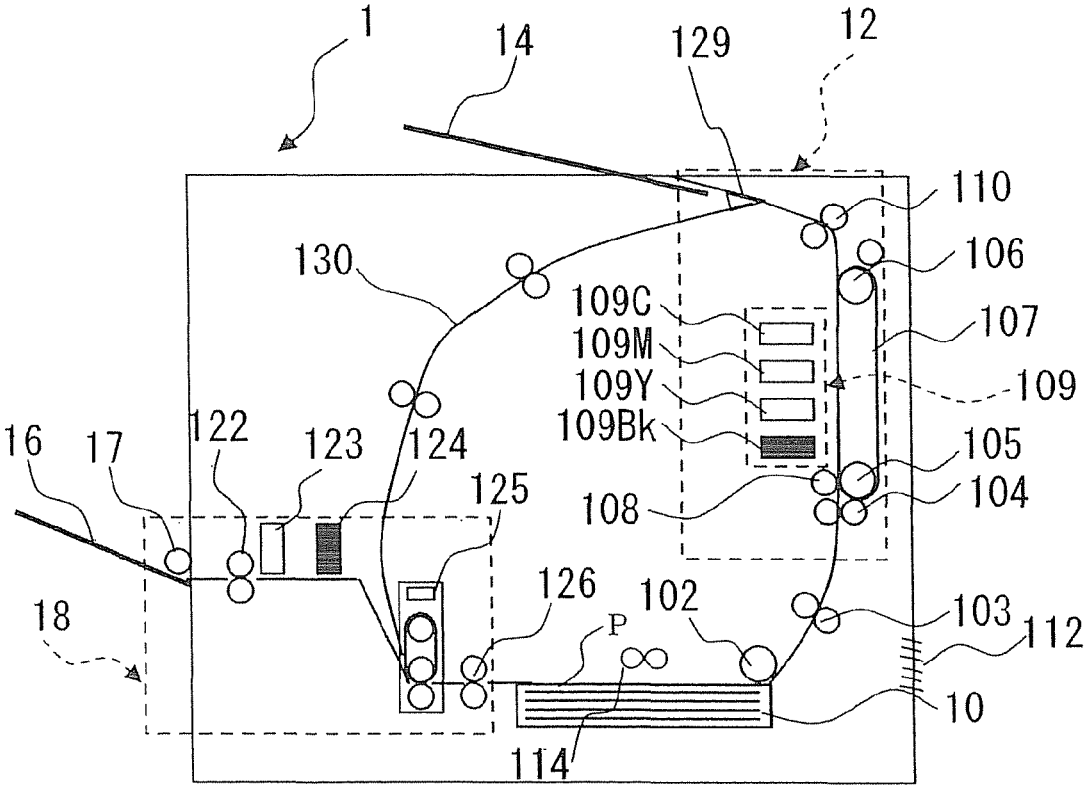
FIG. 1 is a sectional view showing the construction of an image forming apparatus in a first embodiment.

FIG. 1 shows an image forming apparatus 1 provided with an image forming portion using an erasable ink and an image eraser. The image forming apparatus 1 is provided with a sheet cassette 10, an image forming portion 12, a sheet receiving tray 14, a sheet supply tray 16 and a reuse processing portion 18.

The sheet cassette 10 is a cassette which store a sheet. The sheet cassette 10 stores a sheet P for printing on which an image is printed by the image forming portion 12. The image forming portion 12 forms an image on the sheet P. The image forming portion 12 is an inkjet type printer. The image forming portion 12 is a color printer. The sheet discharging tray 14 holds the sheet which was print processed by the image forming portion 12.

The sheet supply tray 16 is a sheet holding portion to hold the sheet which is an object to be reuse processed by the reuse processing portion 18. In the sheet supply tray 16, a sheet on which the confidential document is printed and a sheet on which the general document is printed may be loaded in the mixed state. In this case, a user may load the printed sheet on the sheet supply tray 16 without thinking the presence or absence of the confidential information. The sheet loaded in the sheet supply tray 16 is taken in the inside of the apparatus by a take-in roller 17, and is conveyed to a mark detecting sensor 123 by a conveyor roller 122. The reuse processing portion 18 separates the sheet on which the confidential document is printed from the sheet on which the general document is printed. When the mark detecting sensor 123 detects a mark suggesting that the confidential information is included on the object sheet, the image forming apparatus 1 overwrite prints on the whole surface of the sheet or on the portion corresponding to the confidential information so that the image can not be recognized. In addition, on the sheet from which the mark can not be detected an overwrite printing is not performed, but after the image printed on the sheet P is erased by an image eraser 125, the sheet is guided to the sheet cassette 10 via a conveyor roller 126. On the sheet P loaded in the sheet cassette 10 an image is formed in the image forming portion 12 by a printing instruction from a user.

Next, the construction of the image forming portion 12 will be described in detail. As shown in FIG. 1, the image forming portion 12 is provided with a sheet supply roller 102, a conveyor roller pair 103, an aligning roller pair 104, a drive roller 106, a conveyor belt 107, a pressing roller 108, an inkjet head group 109 (109Bk, 109Y, 109M and 109C) and a conveyor roller pair 110 and so on.

The sheet supply roller 102 takes out each one of the sheets P held in the sheet cassette 10. The sheet supply roller 102 conveys the sheet P taken out from the sheet cassette 10 to the conveyor roller pair 103 and the aligning roller pair 104. The aligning roller pair 104 conveys the sheet P on the conveyor belt 107 at a prescribed timing. A tension is applied to the conveyor belt 107 by the drive roller 107 and an driven roller 105. The conveyor belt 107 is driven with the rotation of the drive roller 106. The pressing roller 108 presses the sheet P to the conveyor belt 107.

In the conveyor belt 107, holes are formed on the surface at a prescribed interval. Inside the conveyor belt 107, a negative pressure chamber not shown is provided which is connected to a fan not shown so as to make the sheet P to be absorbed to the conveyor belt 107. The sheet P is conveyed while being absorbed to the conveyor belt 107.

The inkjet head group 109 is composed of an inkjet head 109Bk, an inkjet head 109Y, an inkjet head 109M and an inkjet head 109C. Each of the inkjet heads 109Bk, 109Y, 109M and 109C is arranged along the conveyor belt 107 in the sequence. For example, in the embodiment shown in FIG. 1, the inkjet heads 109Bk, 109Y, 109M and 109C are arranged in the sequence from an upstream side in the conveying direction of the sheet P by the conveyor belt 107.

The inkjet head 109Bk is an inkjet head which ejects a black (Bk) color ink which can be decolorized. The inkjet head 109Y is an inkjet head which discharges a decolorizable yellow (Y) color ink. The inkjet head 109M is an inkjet head which discharges a decolorizable magenta (M) color ink. The inkjet head 109C is an inkjet head which discharges a decolorizable cyan (C) color ink.

The ink to be used in the image forming portion 12 is not limited to a specific material, but may be an ink which is decolorized by being heating at a prescribed temperature. In addition, the image forming material which can be used as the ink in the image forming portion 12 is disclosed in, for example, Japanese Patent Application Publication No. 2007-212613, Japanese Patent Application Publication No. 2007-90704 and Japanese Patent No. 3711017 and so on.

For example, a basic component of the image forming material such as a decolorizable ink or a toner and so on can be composed of a coloring compound, a developer and a binder resin and so on. Since in such the image forming material, the coloring compound is in the colored state preliminarily by receiving an action of the developer, a user can recognize the colors. When the heat is applied to the image forming material in the colored state, the binder resin is softened, and mainly the developer becomes easy to move from the inside to the surface of the binder resin, and becomes easy to move to and diffuse in the sheet. For this reason, the coloring compound does not become to receive the action from the developer, and the coloring compound is decolorized and the colors can not be recognized as the image forming material.

The coloring compound is a precursor compound of the pigments which form coloring images such as characters or figures. As the coloring compound, to use an electron supplying organic matter is preferable, such as leuco auramines, diaryl phthlides, polyaryl carbinols, acyl auramines, aryl auramines, Rhodamine B lactams, indoline spiropyrans, and flurans.

The developer is a compound which allows the coloring compound to exhibit colors by the mutual interaction (give and receive the electrons or the protons mainly) with the coloring compound. As the developer, to use phenols, phenol metallic salts, carboxylic acid metallic salts, benzophenones, sulfonic acid, salt of sulfonic acid, phosphoric acids, phosphoric acid metallic salts, acid phosphate ester, acid phosphate ester metallic salts, phosphorous acids, phosphorous acid metallic salts and so on is preferable. In addition, the binder resin is to disperse the coloring compound and the developer in the colored state. On the other hand, the binder resin is compatible with the coloring compound in heating and has the property that does not have an affinity with the developer.

The printer to form an image with the ink as the image forming material capable of being decolorized by heating has to be designed so that a temperature equal to or higher than an erasing temperature is not applied to the ink in the print processing. When a temperature within the printer is raised equal to or higher than the erasing temperature, the color of the ink may be erased before the ink is printed on the sheet. In this case, of course, a normal image is not formed on the sheet. Moreover, in consideration of the consumption energy of the printer itself, that the erasing temperature of the ink is set as low as possible is preferable. Accordingly, the printer needs to be designed so that the temperature applied to the ink does not become high as much as possible.

The inkjet heads 109Bk, 109Y, 109M and 109C form images of the respective colors on the sheet P. The inkjet heads 109Bk, 109Y, 109M and 109C discharge the inks corresponding to a black component, a yellow component, a magenta component and a cyan component for the respective color images. The inkjet head group 109 forms a color image on the sheet P by repeatedly printing the respective color images on the sheet P.

The conveyor roller pair 110 discharges the sheet P on which the image is printed by the inkjet head group 109 to the sheet receiving tray 14.

Figure 5:
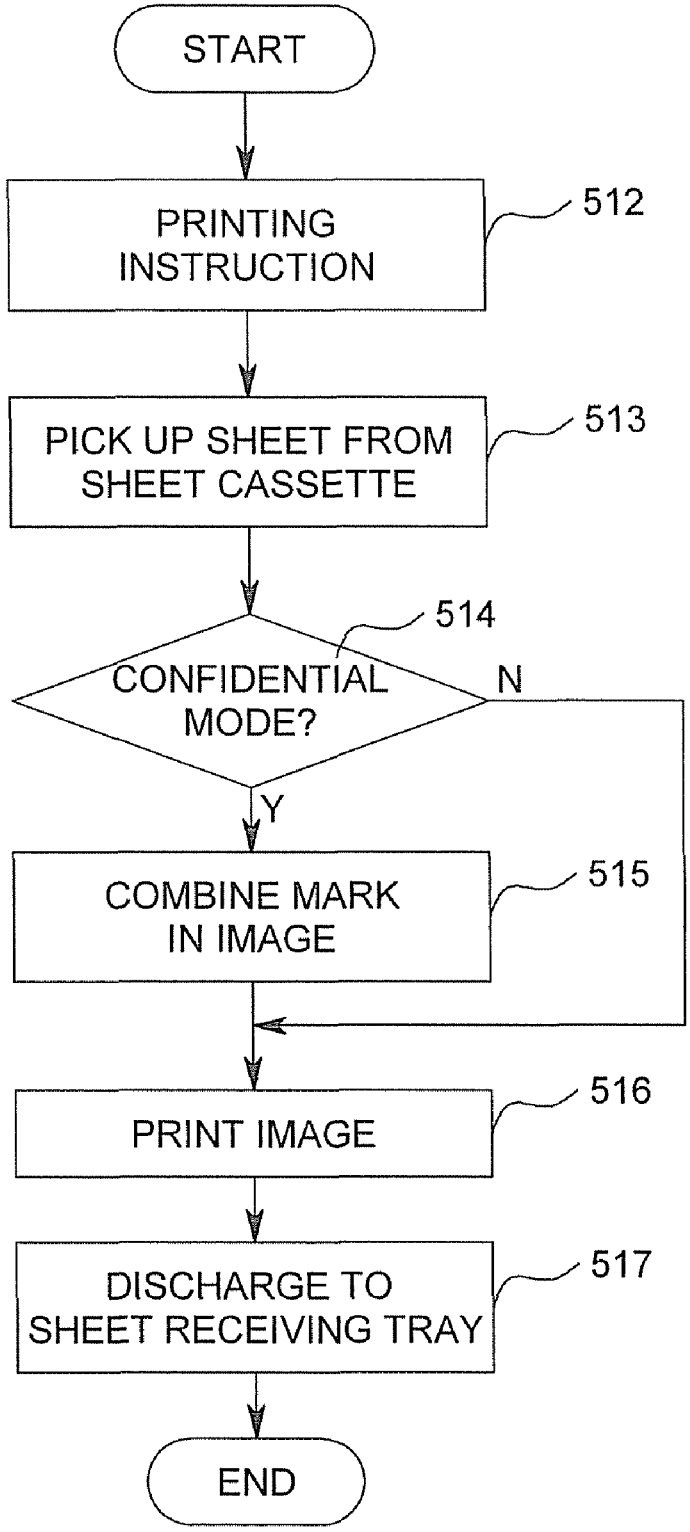
FIG. 5 is a flow chart showing an image forming processing in the image forming apparatus in the first embodiment.

The image forming is performed in the following procedure. FIG. 3 is a drawing showing the construction of the image forming apparatus 1 on the network, and FIG. 5 is a flow chart showing the procedure for the image forming processing. The image forming apparatus 1 is connected to a personal computer (hereinafter called as a PC) 32 or a printer server 33 via a network 31. When the image forming apparatus 1 receives a printing instruction from the PC 32 or an operating panel and so on provided in the image forming apparatus 1 (512), drives the sheet supply roller 102, picks up the sheet P stored in the sheet cassette 10 and conveys the sheet P to the image forming portion 12 (513). In case that the image to be printed is not particularly designated as a confidential mode (514: N), the image forming portion 12 forms the image on the sheet P using the erasable ink, based on the image data transmitted from the printer server 33 (516). The sheet P on which the image is formed is discharged to the sheet receiving tray 14 (517). The image data may be the image data read out by a reading portion (not shown) of the image forming apparatus 1.

In addition, in case that in forming the image the confidential information is included in the image to be formed, when the printing instruction is given by designating a confidential mode, for example, (514: Y), a mark is combined with the image to be formed (515).

The marking is performed in the following. When a printing instruction is given to the image forming apparatus 1 through a printer driver preliminarily installed in the PC 32, that the confidential information is included in the image to be printed is designated on the printer driver, and then the making is made. The instruction for the marking may be a method to make the marking according to the selection of a security print mode provided in the image forming apparatus 1. In addition, a method to make the marking may be used according as a confidential button provided on the operating panel of the image forming apparatus 1 is pushed down and the confidential mode is designated. Further, an image reading apparatus is provided in the image forming apparatus 1 so that by analyzing the header image of the object document to be printed to read out the marks or the characters such as "STRICTLY CONFIDENTIAL", "CONFIDENTIAL" or "FOR INTERNAL USE ONLY" and so on. A method may be used to make the marking based on the recognized result.

Figure 9:
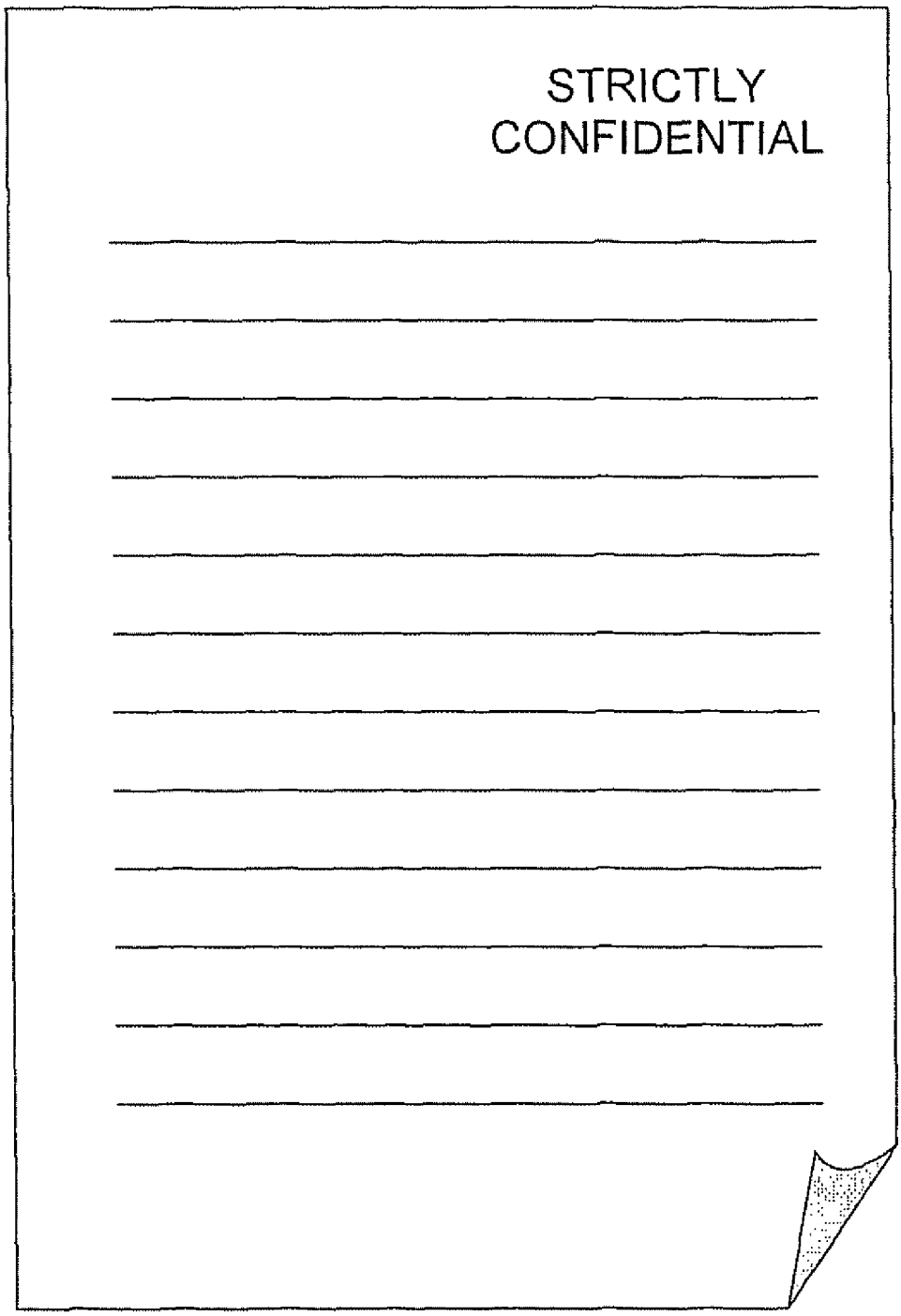
FIG. 9 is a diagram showing a sample on which a mark is printed indicating that the confidential information is included.

A header image as shown in FIG. 9 is thought as the mark, for example. The printer driver or the image forming apparatus is preliminarily provided with an optional function so that the mark according to the height of the confidentiality of the document, such as, "STRICTLY CONFIDENTIAL" as shown in this FIG. is selected and is printed when a printing instruction is given. In addition, when an erasing instruction for the image is given, the mark detecting sensor 123 verifies the read out image with the pattern preliminarily stored in the ROM, and when judged to be coincident, that the confidential matter is included in the object sheet is judged.

In the above-described process, that the confidential information is included in the object document to be printed is designated or judged, the image forming portion 12 prints the image, and at the same time makes the mark suggesting that the confidential information is included on the whole pages.

Next, an example of the marking processing will be described. In case that the image forming apparatus 1 is a color image processing apparatus, the marking is made by slightly changing the ink volumes of the inks of colors C, M and Y to be printed in the image forming portion 12 so as to print in the form which is not easy to visible for the human. The marking is made with a periodic pattern of the high frequency and the low contrast is marked, for example. To imbed the periodic pattern, the volume of the ink is adjusted so that the modulation is given in the yellow color and blue color directions, for example.

To calculate a value Δd which is used for the adjustment of the ink volume is executed using a mathematical formula 1, for example, in case that the n periodic patterns are embedded in the same position given in forming the image.

$$\Delta d = \sum_{m=1}^{n} \frac{\alpha_m}{2} \times \cos\frac{2\pi}{r} \times \begin{pmatrix} x\cos\theta_m + \\ \cos\theta_m \end{pmatrix} \quad \text{[MATHEMATICAL FORMULA 1]}$$

In the mathematical formula 1, α indicates an amplitude of the embedded periodic component, r indicates a frequency (dot/cycle) of the periodic component, θ indicates an angle between the periodic component and the main scanning direction, and x indicates a position in the main scanning direction of the object pixel, and y indicates a position in the vertical scanning direction, respectively. In addition, from Δd obtained from the mathematical formula 1, adjusted values of the volumes of the ink Y, M and C are obtained from a mathematical formula 2.

$$Y' = Y + \frac{\Delta d}{3} \quad \text{[MATHEMATICAL FORMULA 2]}$$

$$M' = M + \frac{\Delta d}{6}$$

By adjusting the ink volumes of the color inks as described above, a periodic pattern modulated in the yellow and blue appears. In addition, by adjusting the pattern to be embedded and the pattern not to be embedded among the n periodic patterns, the approximate position of the confidential information may be represented.

The above-described amplitude α is adjusted so that the amplitude α is changed according to the frequency and the angle of the periodic pattern to be used. According to the visible property of the human and the deterioration property of the output apparatus, for example, the higher the frequency is, the larger the amplitude α is made. In addition, generally the periodic component is not easy to be recognized except the periodic component along the direction of either the main scanning or the vertical scanning. Therefore, assuming that the main scanning direction is 0°, the amplitude α is made small only in the direction which makes an angle corresponding to the multiple number of 90°. In addition, the values of the frequency r, the angle θ and the amplitude a corresponding to them are preliminarily stored in the ROM (not shown) and so on loaded in the image forming apparatus 1.

As the area in which the periodic pattern is embedded, a large area is made including the area in which the image is printed. In addition, the preliminarily designated embedded position and area for the marking may be stored in the ROM, and the ROM may be used. The periodic pattern for the marking is required to be a pattern which is difficult to recognize for the human and a pattern capable of being embedded at the position on which the image is printed. Other than the embedding the periodic pattern, the technique may be adopted to embed the recognizable pattern such as the 2 dimensional bar code and the QR code at the position which does not overlap with the area in which the image is printed.

By the above-described operation, on the sheet P which was printed using the confidential mode of the image forming apparatus 1, a mark suggesting that the confidential information is included is to be formed. By this, when the used sheet loaded in the sheet supply tray 16 passes through the mark detecting sensor 123 via the take-in roller 17 and the conveyor roller 122, the mark is read out. In case that the mark is not detected by the mark detecting sensor 123, the sheet P is passed through the image eraser 125 so that the image is erased, and the sheet P on which the image erasing is finished is stored in the sheet cassette 10.

Next, the image erasing will be described. The image eraser 125 heats the sheet P so that the temperature of the sheet P becomes the erasing temperature of the ink as the image forming material, for example. The image is erased from the sheet P heated at the erasing temperature by the image eraser 125. The image eraser 125 erases the color of the image by giving the heat to the sheet. In this case, as for the erasing mechanism, a construction is thought of which uses a thermal head, a thermal bar or a heat roller. The type which uses the heat roller needs a time so as to raise the temperature of the heat roller to the temperature capable of erasing processing. For, example, in case that the heat roller is not heated preliminarily, the erase processing can not be performed at once to the sheet P which is to be reused and loaded in the sheet supply tray 16. For this reason, depending on the operation condition, the possibility arises that the sheets P to be reused may pile up in the sheet supply tray 16. In addition, in the erasing mechanism which uses the thermal head or the thermal bar, the waiting time to raise the temperature is short. But in the construction that the thermal head or the thermal bar is to be contacted with the surface of the sheet P, as the image forming material such as the ink or the toner becomes easy to attach the thermal head or the thermal bar, the deterioration of the erasing performance is large.

Figure 4:
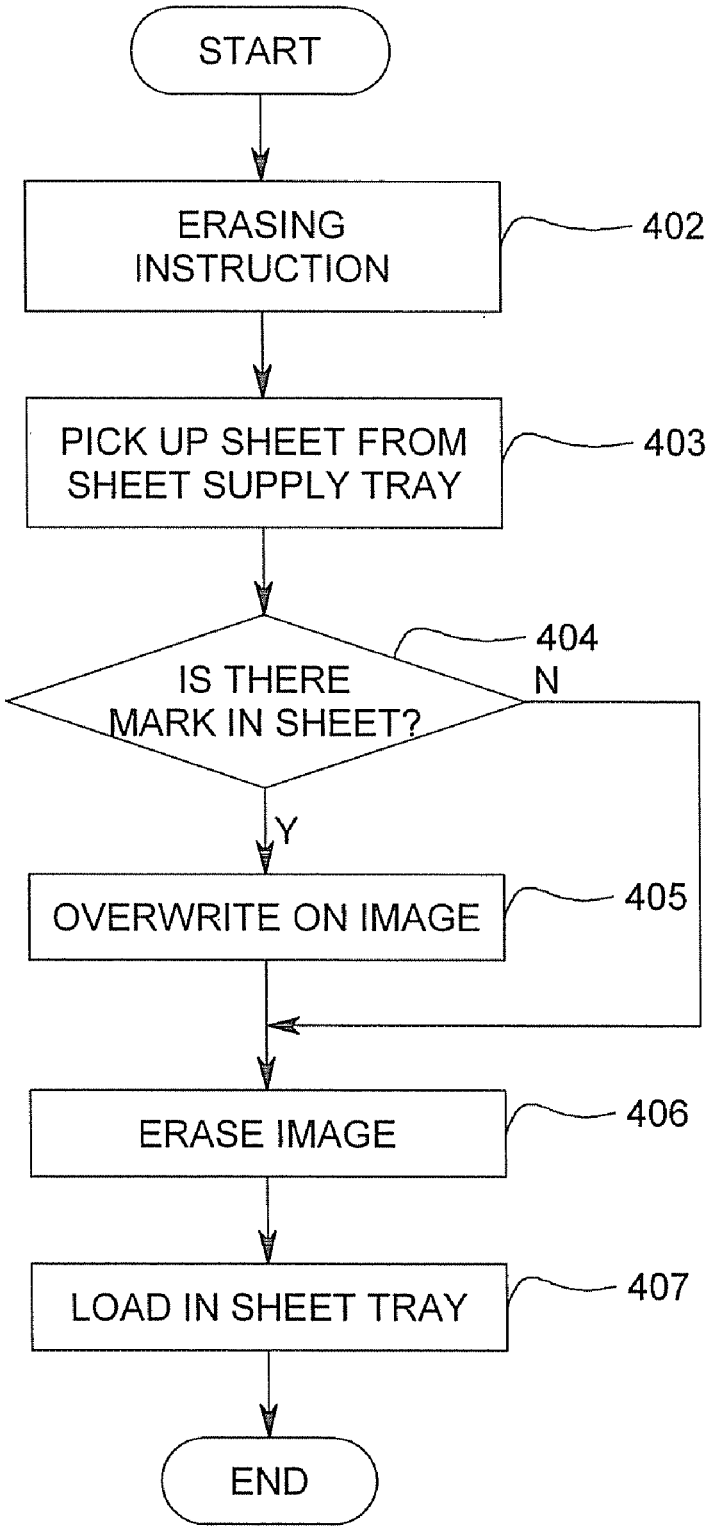
FIG. 4 is a flow chart showing an image erasing processing in the image forming apparatus in the first embodiment.

The erasing processing for the used sheet is performed in the procedure shown in a flow chart of FIG. 4. First, a user loads the used sheet in the sheet supply tray 16. And the user gives an erasing instruction by operating the operating panel and so on provided on the image forming apparatus 1 (402). The image forming apparatus 1 takes in the used sheets loaded in the sheet supply tray 16 sheet by sheet into the inside of the apparatus 1 by driving the take in roller 17. When the sheet passes through the mark detecting sensor 123, that the mark showing the existence of the confidential information exists is judged (404: Y), after an inkjet head 124 overwrites on the image on the sheet (405), the image formed on the sheet is erased by heating the image eraser 125 (406). In case that the mark does not exist (404: N), the image is erased without overwriting. The image forming apparatus 1 stores the image erased sheet in the sheet cassette 10 (407).

The sheet from which the image is erased in the image eraser 125 is once stored in the sheet cassette 10 for a prescribed time. By this, as the sheet which is erased by heating and taking the heat is not printed again unless the prescribed time elapses, the phenomenon can be prevented from arising that the image is decolorized at once even if the heat taking sheet is printed with the erasable ink. In addition, in order not to raise the trouble by the residual heat in the image forming, measures, such as, to provide a vent hole 112 at the sheet cassette 10 or the periphery of the sheet cassette 10, and to provide a fan 114 so that the sheet loaded in the sheet cassette 10 is exposed to the wind may be adopted. Or, a thermistor may be provided at the periphery of the topmost surface of the sheet P loaded in the sheet cassette 10, and even if a printing instruction is given, in case that the surface temperature of the sheet P is equal to or higher than a prescribed temperature, for example, equal to or higher than a temperature T2 as shown in FIG. 2, the sheet supply roller 102 may not be driven, and the sheet P may be on standby in the sheet cassette 10.

By the way, in case that the used sheet which was printed using the erasable ink is reused, to maintain the attached ink in the colored state at a range of the temperature in part including the normal temperature environment is necessary. In addition, after erasing by the image eraser 125, the ink is to be maintained in the decolorized state at a range of the temperature in part including the normal temperature environment. Accordingly, the following temperature and coloring properties for the ink is required. That is, as shown in FIG. 2, the ink begins to be decolorized at a temperature equal to or higher than a temperature T2 (for example, 100° C.) which is considerably higher than a normal temperature T0 (approximately 20° C.), and at a further high temperature T4 the ink becomes completely colorless. On the other hand, the ink begins to exhibit colors at a temperature equal to or lower than a low temperature T1 (for example, 0° C.), and at a further low temperature T3, all the coloring materials begin to exhibit colors. In addition, at the normal temperature T0, the colorization or the non-colorization does not arise and the ink is maintained at a stable state. In case that such the ink is used, when the sheet is cooled at a temperature equal to or lower than the coloring temperature T1, the erased image reappears on the sheet, and the problem in the confidentiality might arise.

For this, in the image forming apparatus 1 of the present embodiment, this problem is resolved by making impossible to decipher the image formed in past times on the used sheet loaded in the sheet supply tray 16. That is, when the mark is detected to indicate that the confidential information is included in the image formed in past times on the used sheet, the image formed in past times is made impossible to decipher by covering the whole surface of the image by the ink or by overwriting the prescribed pattern on the image.

The sheet P from which the mark was detected means that the image formed in the past times is judged to have been a confidential document. In this case, the image forming apparatus 1 prints by the inkjet head 124 in the black color on the whole surface or on the area of the image corresponding to the confidential information. In addition, in case that the mark on the sheet P is arranged at a position distant from the image, a design may be used that by also overwriting on the mark, the mark is not detected again. Then, the sheet P on which the overwrite printing is finished is guided to the image eraser 125 via a sheet conveying path 130 by driving a flapper 129. Here, the image formed on the sheet P is erased along with the overwritten image. As a result, as the erasing is performed after a solid image was formed, even if the temperature is lowered to exhibit colors again, the confidentiality can be maintained as the solid image only emerges.

As described above, by using the image forming apparatus 1 of the first embodiment, in case that the image printed and formed in past times on the used sheet includes the confidential information, to reuse the used sheet can be designed by overwriting the image so that the image formed in past times on the used sheet is made indecipherable. In addition, in the step of printing the image, the pattern suggesting the confidential information is marked at the same time, and in case that a used sheet including the confidential information is mixed in the used sheets in the sheet supply tray 16, the used sheet that is the object to be made indecipherable can be identified. By this, that the confidential information erroneously reappears in the image erasing process can be prevented.

(Second Embodiment) In the above-described first embodiment, the construction is used that the sheet is stored in the shared sheet cassette 10, regardless of whether or not the image formed in past times on the sheet includes the confidential information. And the processing is used to recognize the pattern indicating that the image formed in past times on such the sheet includes the confidential information by the mark detecting sensor 123. But, in case that the above-described pattern deteriorates, the pattern might not be read out by the mark detecting sensor 123. In addition, in the used sheets, the sheet on which the confidential information is printed and the other sheet are mixed, to switch the heating of the image eraser 125 between in the ON state and in the OFF state at each time is difficult. Therefore, in this embodiment, the construction is used that a confidential document cassette 611 is provided differently from the ordinary sheet cassette 10.

Figure 6:
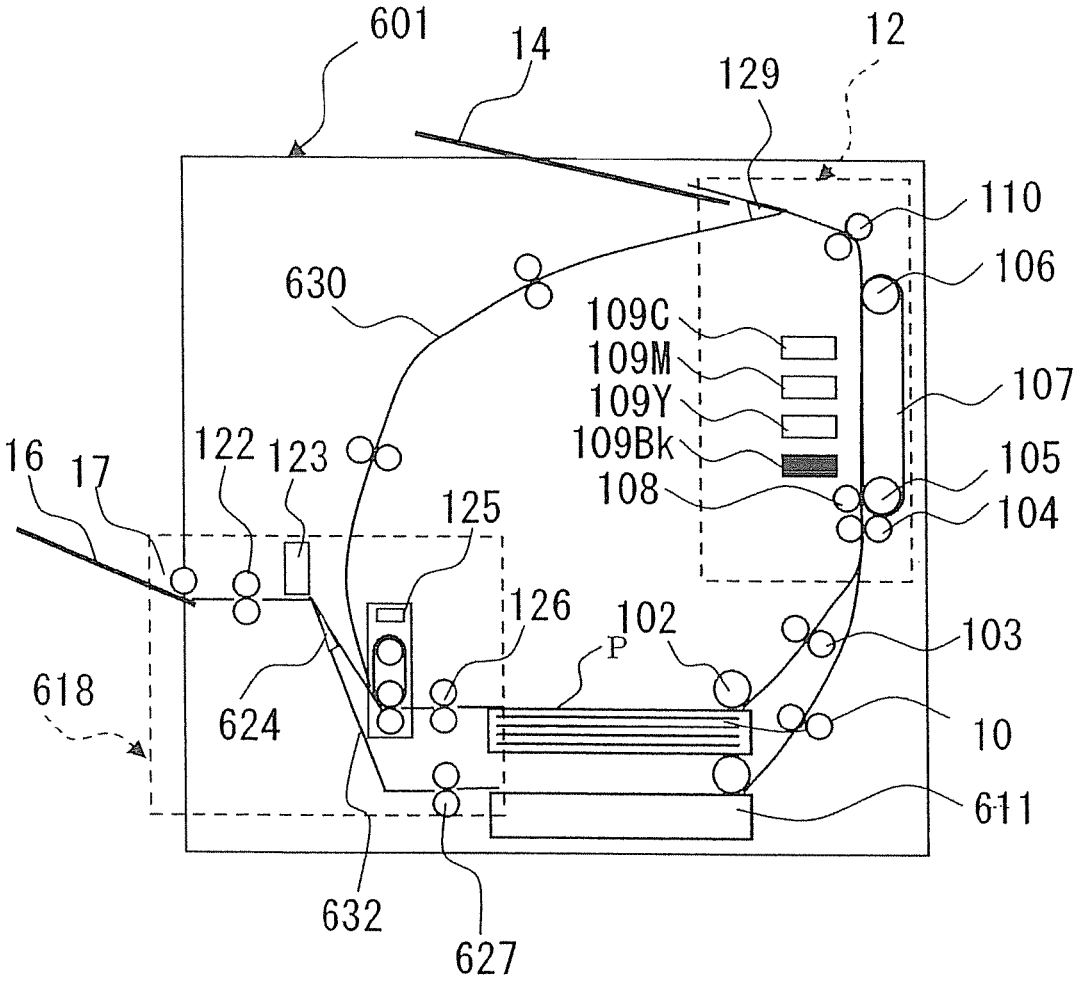
FIG. 6 is a sectional view showing the construction of an image forming apparatus in a second embodiment.

The sheet from which such the mark was detected means that the image formed in past times is judged to have been the confidential document. In this case, as shown in FIG. 6, in an image forming apparatus 601, by driving a flapper 624 a sheet is conveyed along a sheet conveying path 632 via a conveyor roller 627 and is stored in the confidential document cassette 611, and the erasing action is not performed in the image eraser 125. A reuse processing portion 618 includes the flapper 624, the sheet conveying path 632 and the conveyor roller 627. In this case, as the sheet has not passed through the image eraser 125, to cool the sheet is not necessary. Accordingly, such the sheet is immediately supplied to the image forming portion 12, and the printing is performed on such the sheet in the black color by the inkjet head 109Bk with only the erasable black ink on the whole surface or on the area of the image corresponding to the confidential information. By providing a remaining ink detecting sensor in the image forming portion 12, in case that the quantity of the black ink is little, the printing may be performed on the whole surface with the cyan ink of the inkjet head 109C instead of the black ink. By performing the printing, so that the image (confidential information) formed and printed in past times on the sheet with the erasable ink is made impossible to recognize, the erasable image becomes to have been overwrite printed on the sheet. Then, by driving the flapper 129, the overwrite printed sheet is guided to the image erasing portion 25 via the sheet conveying path 630. Here, the image formed on the sheet is erased along with the overwritten image. As a result, as the erasing is performed after solid printing, even in case that the temperature falls down to cause the colorizing again, only the solid figure emerges so that the confidentiality can be maintained.

In the above-described first embodiment, the construction is used that the sheet is loaded in the shared sheet supply tray 16, regardless of whether or not the image printed and formed in past times on the used sheet includes the confidential information. And the processing is used to recognize the pattern indicating that the image formed and printed in past times on such sheet includes the confidential information by the mark detecting sensor 123. But, in case that the above-described pattern deteriorates, the pattern might not be read out by the mark detecting sensor 123. Therefore, in the second embodiment, the construction that the confidential document cassette 611 is provided differently from the ordinary sheet cassette 10.

Figure 7:
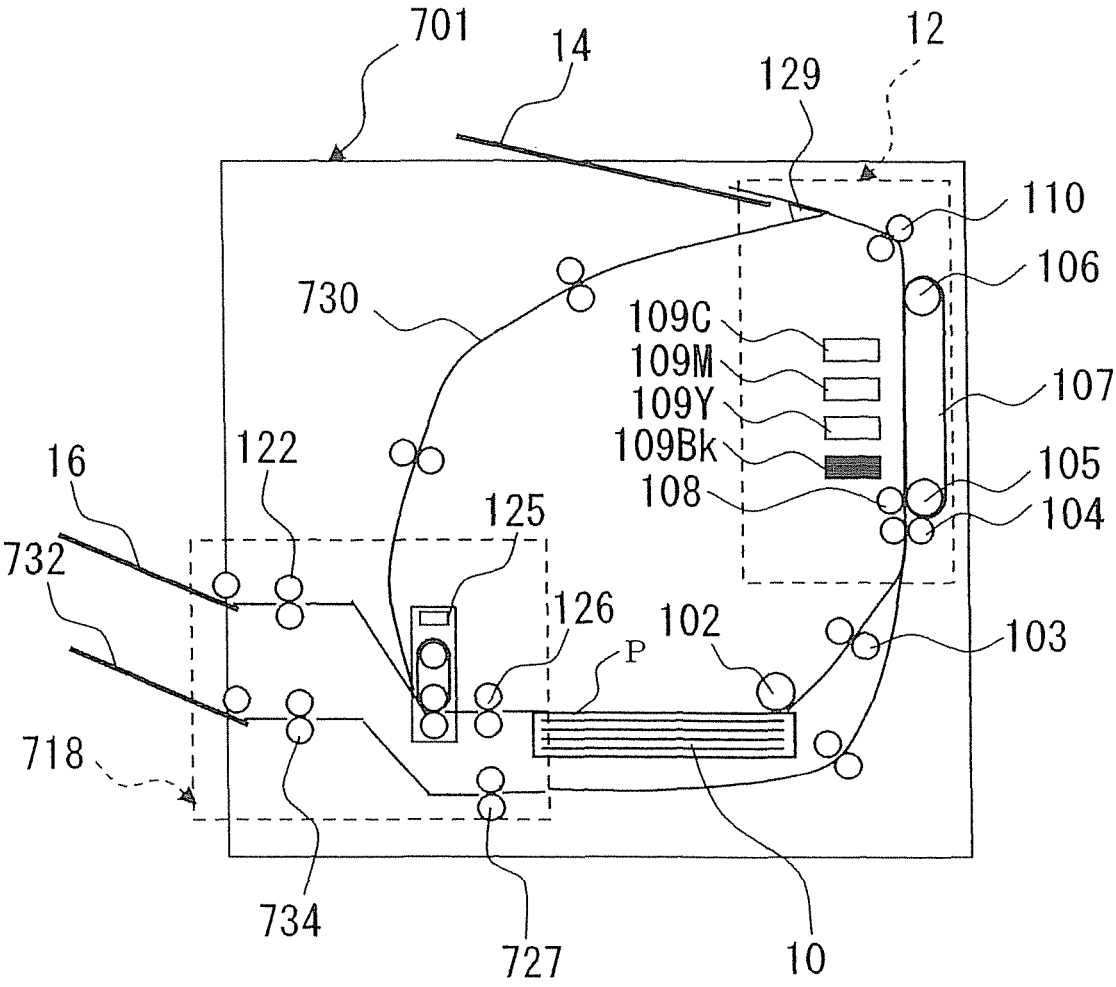
FIG. 7 is a sectional view showing the construction of an image forming apparatus in a third embodiment.

(Third Embodiment) FIG. 7 is a drawing showing the construction of an image forming apparatus 701 according to a third embodiment. This embodiment is different from the first embodiment in that a confidential document tray 732 is provided differently from the sheet supply tray 16 for the ordinary used sheet. In this case, the used sheet loaded in the confidential document tray 732 passes via a conveyor roller 734 and a conveyor roller 727 in the direction toward the black inkjet head 109Bk without passing through the detecting sensor. Then for the all sheets, a meaningless image is overwritten with the black ink by the black inkjet head 109Bk on the whole surface or on the area of the image corresponding to the confidential information. By overwriting the meaningless image on the image formed in past times on the used sheet, the image formed in past times is made impossible to recognize. The overwritten sheet is conveyed to the image eraser 125 via a sheet conveying path 730 in the same manner as in the first embodiment. From the sheet conveyed to the image eraser 125, the image is erased in the same manner as the ordinary used sheet and is stored in the sheet supply cassette 10. A reuse processing portion 718 includes the conveyor rollers 734 and 727 to convey the sheet taken in from the confidential document tray 732.

Figure 8:
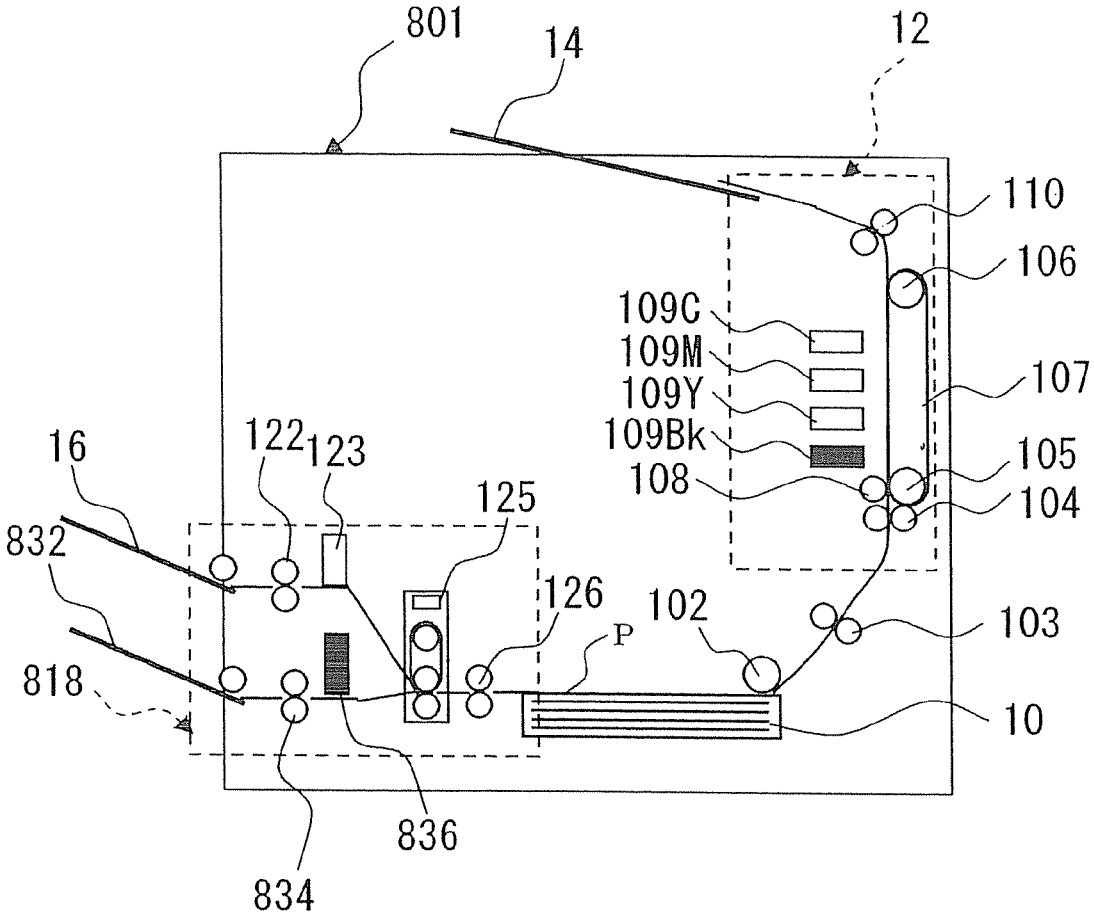
FIG. 8 is a sectional view showing the construction of an image forming apparatus in a fourth embodiment.

(Fourth Embodiment) FIG. 8 is a sectional view of an image forming apparatus 801 showing a fourth embodiment. In the construction of FIG. 7, the used sheet including the confidential information on the image formed in past times might erroneously be loaded in the sheet supply tray 16. Thus, in FIG. 8, as a reuse processing portion 818, the mark detecting sensor 123 is provided between the sheet supply tray 16 and the image eraser 125. In addition, a conveyor roller 834 and a printing head 836 exclusive for the security are provided between a confidential document tray 832 and the image eraser 125.

In the image forming apparatus 801, when the used sheet loaded in the confidential document tray 832 is conveyed to the inside, the sheet is at once printed in black on the whole surface by the printing head 836. That is, by overwriting the meaningless image on the image formed in past times on the used sheet, the image formed in past times is made impossible to recognize. Then, the sheet is conveyed to the image eraser 125 and the image is erased. The sheet from which the image is erased by the image eraser 125 is once stored in the sheet cassette 10 for a prescribed time. By this, as the sheet which is erased by heating and taking the heat is not printed again unless the prescribed time elapses, the phenomenon can be prevented from arising that the image is decolorized at once even if the heat taking sheet is printed with the erasable ink. On the other hand, in case that the used sheet including the confidential information on the image formed in past times is erroneously loaded in the sheet supply tray 16, that the sheet is a marking processed sheet is detected by the mark detecting sensor 123. The detected sheet passes through the image eraser 125 and the image forming portion 12, and is discharged on the sheet receiving tray 14. In this case, that the sheet is the marking processed sheet is informed to the operator. For, example, "load the sheet discharged in the sheet receiving tray on the confidential document tray, please" is displayed on the operating panel.

As described above, by providing the confidential document tray differently from the tray for the ordinary used sheet, the construction is employed that the used sheet loaded in the confidential document tray is directly conveyed to the image forming portion or the printing head, and is printed in the black on the whole surface. Thus, the image formed in past times on the used sheet can be made completely impossible to recognize. In addition, the image forming apparatus may be constructed such that the recognizable image can not emerge, by storing a decolorizing agent such as choric acid and so on in the printing head 836 and by over coating on whole surface or coating at random.

Figure 10:
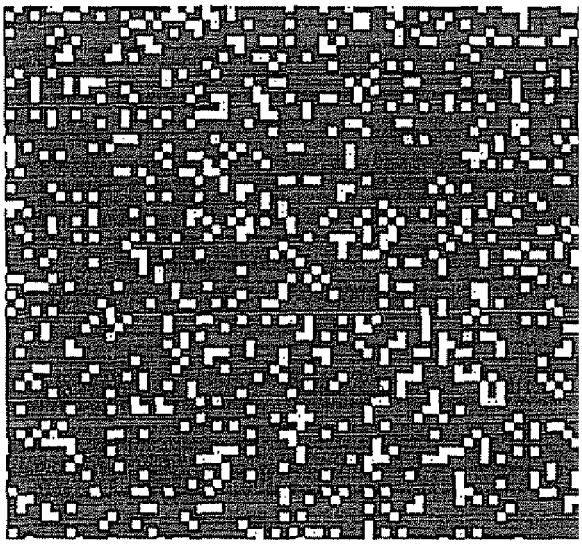
FIG. 10 is a diagram showing an overwritten example so that the image formed in past times might not be read.

The example that the sheet is coated at random is shown in FIG. 10. The pattern coated at random may be provided with such the density that the image formed in past times can not be read, and the more irregular the pattern is, the more difficult to recognize the image formed in past times is. In addition, as the overcoat is sufficient to hide the image formed in past times, the image forming the shape of character string of the large size as shown in FIG. 11 may be overwritten.

In the above-described embodiments, the ink is used as the erasable coloring substance, but the present invention is not limited to the embodiments, and the erasable toner may be used.

In addition, in the present invention, the above-described embodiments may be modified arbitrarily in an area without departing from the gist of the present invention. In addition, the above-described embodiments may be combined arbitrarily.

What is claimed is:

1. An image forming apparatus, comprising:

a sheet supply portion that loads a sheet on which a first image is formed with color erasable image forming material;

an image forming portion that overwrites the first image with a second image using the color erasable image forming material when the sheet on which the first image is formed is conveyed from the sheet supply portion; and a color erasing portion to erase color of the first and second images on the sheet which is conveyed from the image forming portion.

2. The apparatus according to claim 1, further comprising:

a detecting portion that judges whether the sheet conveyed from the sheet supply portion has the first image formed with the color erasable image forming material;

wherein the image forming portion overwrites the second image with the color erasing image forming material on the first image of the sheet.

3. The apparatus according to claim 1, further comprising:

a detecting portion that reads the image of the sheet conveyed from the sheet supply portion and to detect whether or not a mark exists;

wherein the image forming portion, in case that the mark is detected by the detecting portion, overwrites the second image with color erasable image forming material on the first image of the sheet.

4. The apparatus according to claim 3, wherein the detecting portion is arranged between the sheet supply portion and the color erasing portion the sheet supply portion.

5. The apparatus according to claim 3, wherein the color erasing portion erases the first image on the sheet whose the second image was not overwritten by the image forming portion if the detecting portion does not detect the mark.

6. The apparatus according to claim 3, further comprising:

a sheet cassette to store the sheet from which the image is color erased by the color erasing portion; and another image forming portion which is different from the image forming portion and forms a third image on the sheet supplied from the sheet cassette with color erasable image forming material.

7. The, apparatus according to claim 6, wherein the another image forming portion prints the mark to be detected by the detecting portion along with the third image.

8. The apparatus according to claim 6, wherein the color erasable image forming material, which is used to form the first, second and third images, color erases if the first and second images are heated at an erasing temperature and the color erasable image forming material exhibits color again if the first, second and third images are cooled at below a predetermined temperature lower than the erasing temperature in a color erased state.

9. The apparatus according to claim 3, further comprising:

a first sheet cassette to store the sheet in the state that the first image is formed in case that the mark is detected by the detecting portion; and a second sheet cassette to store the sheet from which the image is color erased by the color erasing portion, wherein the image forming portion overwrites the second image with color erasable image forming material on the first image for the sheet conveyed from first sheet cassette; and forms a third image for the sheet conveyed from the second sheet cassette.

10. The apparatus according to claim 3, wherein the mark indicates that the first image is confidential information.

11. The apparatus according to claim 3, wherein the overwriting signifies to print the second image on the first image so as not to make the first image recognizable.

12. The apparatus according to claim 1, wherein the sheet supply portion includes a first sheet supply portion to load a sheet and a second sheet supply portion, and the image forming portion is arranged along a conveying path to convey the sheet from the second sheet supply portion to the color erasing portion and overwrites image with color erasable image forming material on the second image of the sheet supplied from the sheet supply portion before erasing color of the image by the color erasing portion.

13. The apparatus according to claim 12, further comprising:

a sheet cassette to store the sheet which is color erased by the color erasing portion; and another image forming portion which is different from the image forming portion and forms a third image on the sheet supplied from the sheet cassette with color erasable image forming material.

14. The apparatus according to claim 12, further comprising:

a sheet cassette to store the sheet which is color erased by the color erasing portion;

a first conveying portion to convey the sheet supplied from the first sheet supply portion to the color erasing portion;

a second conveying portion to convey the sheet supplied from the second sheet supply portion to the image forming portion; and a third conveying portion to convey the sheet on which the second image is formed by the image forming portion to the color erasing portion, wherein the image forming portion additionally performs an action to form a third image with color erasable image forming material for the sheet conveyed from the sheet cassette.

15. The apparatus according to claim 12, wherein the color erasable image forming material, which is used to form the first and second images, color erases if the first and second images are heated at an erasing temperature and the color erasable image forming material exhibits color again if the first and second images are cooled at below a predetermined temperature lower than the erasing temperature in a color erased state, and wherein the color erasing portion erases the first and second images on the sheet by heating, at the erasing temperature, the sheet on which the image forming portion overwrites the second image on the first image.

16. The apparatus according to claim 1, further comprising:

a detecting portion, arranged between the sheet supply portion and the color erasing portion, to read an image on the sheet conveyed from the sheet supply portion; and a storing portion to store a prescribed pattern image, wherein the image forming portion overwrites the second image on the first image of the sheet if the image read by the detecting portion coincides with the prescribed pattern image stored in the storing portion.

17. The apparatus according to claim 1, wherein the color erasable image forming material, which is used to form the first and second images, color erases if the first and second images are heated at an erasing temperature and the color erasable image forming material exhibits color again if the first and second images are cooled at below a predetermined temperature lower than the erasing temperature in a color erased state, and wherein the color erasing portion erases the first and second images on the sheet by heating, at the erasing temperature, the sheet on which the image forming portion overwrites the second image on the first image.

18. An image forming method, comprising:

supplying a sheet from a sheet supply portion to load the sheet on which a first image is formed with color erasable image forming material;

color erasing the first image of the sheet in case that the sheet supplied form the sheet supply portion is in a first state;

at an image forming portion, overwriting a second image on the first image of the sheet in case that the sheet supplied form the sheet supply portion is in a second state; and color erasing the first and second images of the sheet which is conveyed from the image forming portion.

19. The method according to claim 18, further comprising:

supplying the sheet from which the image is color erased; and forming a third image on the color erased sheet. /

20. The method according to claim 18, wherein the sheet supply portion has a first sheet supply portion to load the sheet in the first state and a second sheet supply portion to load the sheet in the second state.

21. The method according to claim 18, further comprising:

detecting whether or not a mark which is image formed exists on the sheet supplied from the sheet supply portion;

color erasing the first image on the sheet in case that the sheet is in the first state that the mark does not exist;

overwriting the second image on the first image on the sheet in case that the sheet is in the second state that the mark exists; and color erasing the image of the sheet on which the second image is overwritten on the first image.

22. The method according to claim 21, further comprising:

supplying the sheet from which the image is color erased; and printing a third image and the mark on the color erased sheet.

* * * * *